US011024950B2

(12) United States Patent
Hening et al.

(10) Patent No.: US 11,024,950 B2
(45) Date of Patent: Jun. 1, 2021

(54) WIDEBAND LASER-INDUCED PLASMA FILAMENT ANTENNA WITH MODULATED CONDUCTIVITY

(71) Applicant: United States Government as represented by the Secretary of the Navy, San Diego, CA (US)

(72) Inventors: Alexandru Hening, San Diego, CA (US); Ryan P. Lu, San Diego, CA (US); Ayax D. Ramirez, Chula Vista, CA (US); Britanny Lynn, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 431 days.

(21) Appl. No.: 16/206,280

(22) Filed: Nov. 30, 2018

(65) Prior Publication Data

US 2020/0176856 A1 Jun. 4, 2020

(51) Int. Cl.

| | |
|---|---|
| ***H01Q 9/04*** | (2006.01) |
| ***H01Q 15/14*** | (2006.01) |
| ***H01Q 1/26*** | (2006.01) |
| ***H01Q 9/16*** | (2006.01) |
| ***H01Q 3/01*** | (2006.01) |
| ***H01Q 19/10*** | (2006.01) |
| *H05H 1/24* | (2006.01) |

(52) U.S. Cl.

CPC ..... *H01Q 1/26* (2013.01); *H01Q 3/01* (2013.01); *H01Q 9/16* (2013.01); *H01Q 19/108* (2013.01); *H05H 1/24* (2013.01)

(58) Field of Classification Search

CPC .. H01Q 1/26; H01Q 1/38; H01Q 3/01; H01Q 3/44; H01Q 9/04; H01Q 9/14; H01Q 15/14; H01Q 19/10; H01Q 15/148

See application file for complete search history.

(56) References Cited

U.S. PATENT DOCUMENTS

| | | | |
|---|---|---|---|
| 3,404,403 | A | 10/1968 | Vallese et al. |
| 6,650,297 | B2 | 11/2003 | Anderson et al. |
| 6,825,814 | B2 | 11/2004 | Hayes |

(Continued)

OTHER PUBLICATIONS

M. Alshershby et al.; Reconfigurable Plasma Antenna Produced in Air by Laser-induced Filaments: Passive Radar Application; Applied Physics Letters 102 (2013).

(Continued)

*Primary Examiner* — Blane J Jackson

(74) *Attorney, Agent, or Firm* — Naval Information Warfare Center, Pacific; Kyle Eppele; J. Eric Anderson

(57) ABSTRACT

An antenna comprising: a radio frequency (RF) coupler; a transceiver communicatively coupled to the RF coupler; a laser configured to generate a plurality of femtosecond laser pulses so as to create, without the use of high voltage electrodes, a laser-induced plasma filament (LIPF) in atmospheric air, wherein the laser is operatively coupled to the RF coupler such that RF energy is transferred between the LIPF and the RF coupler; and wherein the laser is configured to modulate a characteristic of the laser pulses at a rate within the range of 1 Hz to 1 GHz so as to modulate a conduction efficiency of the LIPF thereby creating a variable impedance LIPF antenna.

12 Claims, 8 Drawing Sheets

(56) References Cited

U.S. PATENT DOCUMENTS

| | | | | |
|---|---|---|---|---|
| 7,456,791 | B2 * | 11/2008 | Pellet | H01Q 1/34 343/701 |
| 10,069,564 | B2 | 9/2018 | Hening et al. | |
| 10,601,125 | B2 * | 3/2020 | Cohen | H01Q 1/366 |
| 2005/0122272 | A1 | 6/2005 | Pellet | |
| 2009/0015489 | A1 * | 1/2009 | Marquis | H05H 1/46 343/701 |

OTHER PUBLICATIONS

J. Papeer et al.; Uniform lifetime prolongation of a high density plasma channel left in the wake of femtosecond filament; Applied Physics Letters 111, 074102 (2017).

G. Point et al.; Long-lived laser-induced arc discharges for energy channeling applications; Scientific Reports; Oct. 23, 2017.

Y. Brelet et al.; Radiofrequency plasma antenna generated by femtosecond laser filaments in air; Applied Physics Letters 101, 264106 (2012).

C. D'Amico et al.; Dipolar-like antenna emission in the radiofrequency range by laser-produced plasma channels in air; Journal of Physics D: Applied Physics 41, 245206 (2008).

M. Alshershby et al.; Reconfigurable Plasma Antenna Produced in Air by Laser-induced Filaments; Passive Radar Application; International Conference on Optoelectronics and Microelectronics (ICOM) (2012).

X. Bai; Laser-induced plasma as a function of the laser parameters and the ambient gas; Plasma Physics; Universite Claude Bernard-Lyon I, 2014.

* cited by examiner

WIDEBAND LASER-INDUCED PLASMA FILAMENT ANTENNA WITH MODULATED CONDUCTIVITY

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 103636.

BACKGROUND OF THE INVENTION

In many different situations it is desirable to erect an antenna to facilitate wireless communications. For example, in emergency first responder and military scenarios it is important to set up field communications quickly. However, there are many challenges to rapidly setting up or re-establishing wireless communications, including the length of the antenna, placement/orientation of the antenna, weight of the antenna, etcetera. For example, many prior art, portable, high frequency (HF), omni-directional antennas for 2-30 MHz are approximately 10 meters (35 feet) in length, weigh approximately 200 lbs. and require approximately 30 minutes to set up and an additional 30-40 minutes to collapse and store for the subsequent deployment. Set up and take down times can be adversely affected by weather and by tactical conditions in military and first responder situations. There is a need for an improved antenna and method for deploying and taking down the same.

SUMMARY

Described herein is a method for modulating a laser-induced plasma filament (LIPF) antenna comprising the following steps. The first step provides for using a laser to generate a LIPF within an optically-transparent medium. The laser is configured with an energy of at least 100 mJ and a pulse duration no longer than 20 ns. Another step provides for communicatively coupling the LIPF to a transceiver. Another step provides for modulating a conduction efficiency of the LIPF by adjusting the LIPF's localized energy density at a rate within the range of 1 Hz to 1 GHz thereby creating a variable impedance LIPF antenna.

An embodiment of the modulated LIPF antenna disclosed herein may be described as comprising a radio frequency (RF) coupler a transceiver, and a laser. The transceiver is communicatively coupled to the RF coupler. In this embodiment, the laser is configured to generate a plurality of femtosecond laser pulses so as to create, without the use of high voltage electrodes, a LIPF in atmospheric air. The laser is operatively coupled to the RF coupler such that RF energy is transferred between the LIPF and the RF coupler. The laser is also configured to modulate a characteristic of the laser pulses at a rate within the range of 1 Hz to 1 GHz so as to modulate a conduction efficiency of the LIPF so as to create a variable impedance LIPF antenna.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and antenna below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

Figure 1:
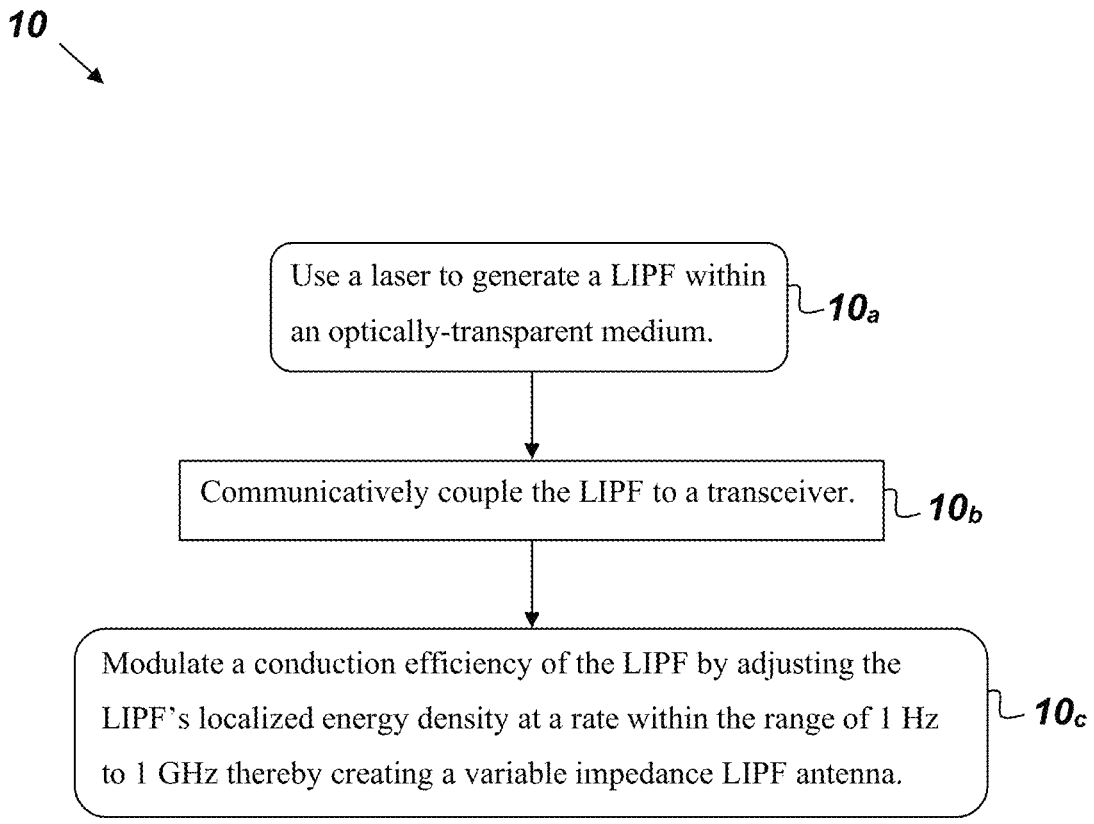
FIG. 1 is a flowchart of a method.

FIG. 1 is a flowchart of a method 10 for modulating a LIPF antenna comprising the following steps. The first step $\mathbf{10}_a$ provides for using a laser to generate a LIPF within an optically-transparent medium such as air. The laser is configured with an energy of at least 100 mJ and a pulse duration no longer than 20 ns. Another step $\mathbf{10}_b$ provides for communicatively coupling the LIPF to a transceiver. Another step $\mathbf{10}_c$ provides for modulating a conduction efficiency of the LIPF by adjusting the LIPF's localized energy density at a rate within the range of 1 Hz to 1 GHz thereby creating a variable impedance LIPF antenna. This modulated LIPF antenna can be instantaneously deployed and retracted as desired based on the conductive properties of the LIPF. The energy density may be adjusted by altering a characteristic of the laser including, but not limited to: pulse duration, beam diameter, beam profile, optical focal length, pulse shape, power, and frequency. Adjusting the energy density of the modulated LIPF antenna (such as is depicted in FIG. 2) allows one to rapidly reconfigure the performance of the modulated LIPF antenna including, but not limited to, the directivity, gain, and efficiency.

Figure 2:
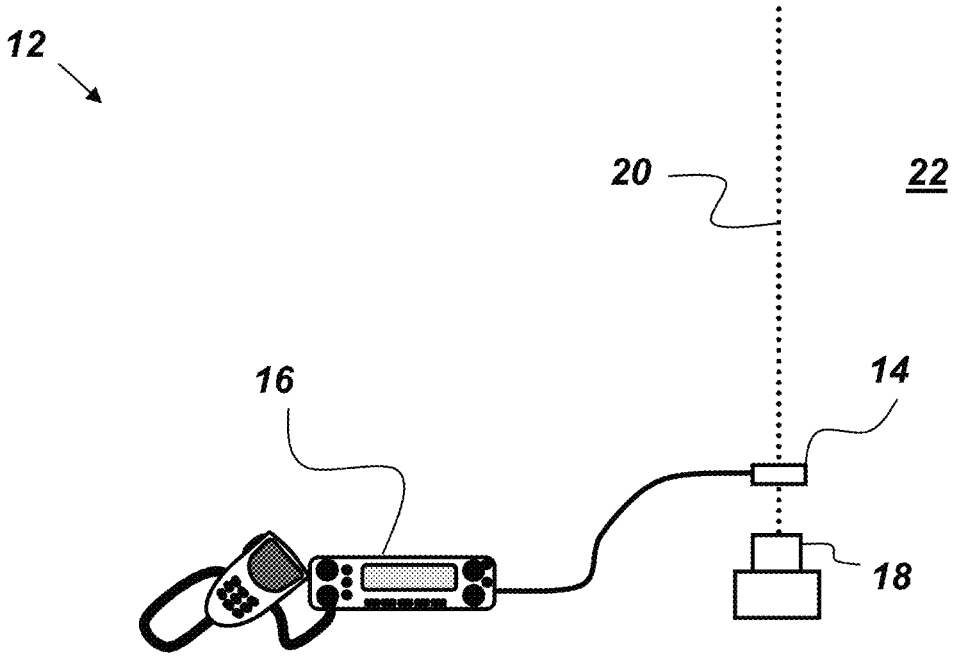
FIG. 2 is an illustration of an embodiment of a modulated LIPF antenna.

FIG. 2 is an illustration of an embodiment of a LIPF antenna 12 comprising: an RF coupler 14, a transceiver 16, and a laser 18. The transceiver 16 is communicatively coupled to the RF coupler 14. In this embodiment, the laser 18 is configured to generate a plurality of femtosecond laser pulses so as to create, without the use of high voltage electrodes, a LIPF 20 in atmospheric air 22. The laser 18 is operatively coupled to the RF coupler 14 such that RF energy is transferred between the LIPF 20 and the RF coupler 14. The laser 18 is also configured to modulate a characteristic of the laser pulses at a rate within the range of 1 Hz to 1 GHz so as to modulate a conduction efficiency of the LIPF 20 such that the LIPF antenna 12 is a variable impedance antenna. Suitable examples of the RF coupler 14 include, but are not limited to a current probe configured to transfer RF energy to/from the LIPF via magnetic induction, and a capacitive coupler configured to transfer RF energy to/from the LIPF via capacitive coupling. For example, the RF coupler 14 may be the current injection device disclosed in U.S. Pat. No. 6,492,956 to Fischer et al., which patent is incorporated herein by reference. A suitable example of the laser 18 includes, but is not limited to an excimer laser. In addition, various types of ultrafast lasers can also be used, from UV to Mid IR. In an example embodiment, the laser 18 may be a krypton fluoride laser configured with the following characteristics: λ=248 nm, E=400 mJ, pulse duration of t=20 ns, and P~20 MW. In another example embodiment, the laser 18 may be a krypton fluoride laser configured with the following characteristics: KrF, λ=308 nm, E=1.0 J, pulse duration of t=20 ns, and P 50 MW.

Figure 3:
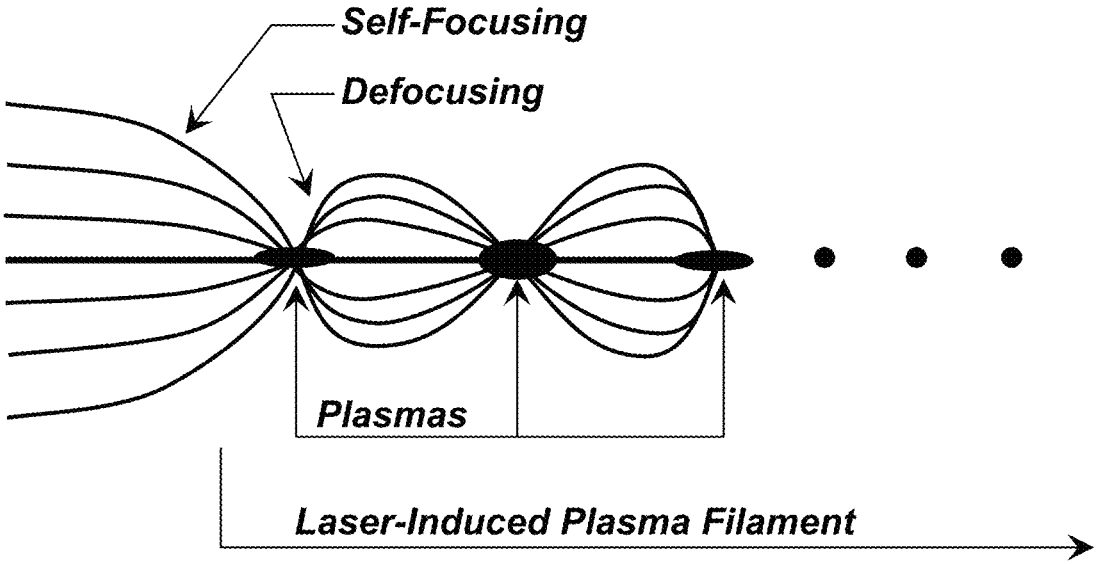
Fig. 3 Prior Art
FIG. 3 is an illustration of the formation and evolution of a LIPF.

FIG. 3 is an illustration of the formation and evolution of a LIPF as is known in the art. During the LIPF's propagation in air, an intense short IR laser pulse first undergoes self-focusing, because of the optical Kerr effect, until the peak intensity on axis becomes high enough (~$5*10^{13}$ W/cm$^2$) to ionize air molecules. The ionization process involves the simultaneous absorption of 8-10 infrared photons, has a threshold-like behavior and a strong clamping effect on the intensity in the self-guided pulse. A dynamical competition then starts taking place between the self-focusing effect due to the optical Kerr effect and the defocusing effect due to the created plasma and optical diffraction. As a result, the pulse is capable of maintaining a small beam diameter and high peak intensity over large distances.

Laser-beam propagation through optically transparent media is influenced by many parameters such as, the laser pulse energy, the temporal and spatial beam profile, the wavelength, the repetition rate, and the physical properties of the propagating media. The index of refraction of an optically transparent media is affected by the presence of an intense electromagnetic field associated with the laser beam; the process is highly localized and has an almost instantaneous response time. The net result is a "lens like" effect and the laser beam will be focused because the wave front is changing the index of refraction of its propagating media. The generated laser-induced plasma will increase the dispersion of the laser beam as the high density of electrons and ions in the plasma leads to a diverging (defocused) laser beam. The process will be re-initiated and the overall effect is an array of focusing-defocusing cycles (as shown in FIG. 3), which is referred to as a "filament" or plasma channel.

It has been shown that self-focusing occurs when the laser power exceeds a critical threshold ($P_{cr}$ critical power); beyond that value, the intensity-dependent refractive index enables the pulse to overcome the natural diffraction spreading and begin to self-focus. The self-focusing effect is the crucial element in filament formation. The Kerr effect is a third-order non-linear optical process and is due to the intensity-dependent index of refraction. The critical power for a Gaussian beam is calculated as $$P_{cr} = \frac{3.37\lambda^2}{8\pi n_0 n_2}, \quad \text{(Eq. 1)}$$

where $n_0$ is the linear refractive index, $n_2$ is the non-linear refractive index, and λ is the wavelength of the laser source, such as the laser 12. Typical values for $n_2$ are $n_2=5.0\times10^{-19}$ cm$^2$/W for air and $n_2=4.1\times10^{-16}$ cm$^2$/W for water. For reference, in vacuum, $n_2=1.0\times10^{-34}$ cm$^2$/W. Above the critical power, filaments begin to develop and could propagate for distances varying from a few centimeters to a few kilometers.

Some values for critical power in air $P_{cr}$=3 GW at λ=800 nm and $P_{cr}$=270 MW at =248 nm. Another element in laser-induced plasma filament propagation is the distance from the laser that the filament is initiated. A semi-empirical formula for the distance $z_c$ that an initially collimated Gaussian beam of waist $w_0$ and wavenumber $k_0=2\pi/\lambda_0$ will collapse if its power is larger than $P_{cr}$:

$$z_c=0.184(w_0)^2k_0/\{[P/P_{cr})^{1/2}-0.853]^2-0.0219\}^{-1/2}, \quad \text{(Eq. 2)}$$

or $$z_c=0.367\pi n_0(w_0)^2\{[(P/P_{cr})^{1/2}-0.853]^2-0.0219\}^{-1/2}. \quad \text{(Eq. 3)}$$

This expression provides a good estimation of the onset of filamentation for a Gaussian beam in the single-filament regime and gives flexibility to adjust the position of the laser-induced plasma filament. To achieve the self-guided propagation of a collimated beam, which defines the filamentation regime, a dynamical balance between the focusing and the defocusing effects must be established.

The filamentation regime possible from the propagation of high-power, ultra-short laser pulses in air is very attractive for atmospheric applications because it allows for conveying high optical intensities at long distances. Further, a precise control of the onset of filamentation can be achieved through simple strategies. It is possible to generate a filament at the desired location even at distances from the laser source of the order of hundreds of meters or even a few kilometers. During such long-range propagation, air turbulence must be considered as a potential source of increased losses and beam instability, that filamentation exhibits remarkable robustness against typical atmospheric perturbations of the refractive index.

Simple antennas (such as a traditional monopole or dipole) have a fairly narrow resonant frequency which makes them fairly efficient at one particular frequency (when accounting for the need to match the transmission line impedance). Electrically short antennas (generally those whose maximum dimension is 1/10 of the wavelength of interest or less) are often capacitively top-loaded by the placement of expanses of conductive material at the far end of the antenna (such as in a top-hat antenna). This conductive material (which generally expands out orthogonally from the main line of the antenna) adds capacitance to the antenna, thereby reducing the size of its negative reactance and reduces impedance mismatch over a range of frequencies. This makes the antenna more broadband when accounting for impedance mismatch with the transmission line.

Another technique used to increase the bandwidth of an antenna is the intentional inclusion of resistance within the design. Such is the case with some prior art folded monopoles or dipoles where the antenna projects away from the radio/transmission line and its far end is connected through a resistor to another antenna segment which returns to the transmission line/radio. Though this introduces losses, in some cases the improvement in bandwidth is enough to warrant its use.

The modulated LIPF antenna 12, on the other hand, is capable of providing efficient wideband communications (e.g., from 3 kilohertz to 3 gigahertz) by using a modulated conductivity mechanism generated by laser-induced filaments. The modulated LIPF antenna 12 has a variable conductivity, which can be altered based on the power of the pulsed laser. Having a variable conductivity enables some control over the resonant behavior of the modulated LIPF antenna 12. This capability is useful for dynamically changing the operating frequency of the antenna or turning elements on and/or off for an adaptive configuration array. In the wake of the self-guided pulse, a plasma column is created with an initial density of $10^{13}$-$10^{17}$ electrons/cm$^3$ over a distance which depends on initial laser conditions. This length can reach hundreds of meters at higher powers and typical LIPF equivalent resistivity could be as low as 0.1 Ω/cm.

Dynamically changing the shape and/or material properties of parts of an antenna can significantly alter the antenna performance. It is possible to change the conductive properties of some materials through an electric current or optical signal. If part of an antenna changes from conductive to resistive then the frequency behavior of the antenna changes. Only a few materials (smart), are capable of changing their conductivity in response to a signal. A smart material is defined as material that can sense and adapt to external stimuli. The LIPF 20 is such a "material". The modulated LIPF antenna 12 is capable of providing a custom and (optionally) dynamic shape and/or conductivity profile via tailored focusing of the laser that is inducing the plasma. This enables the generation of a laser-induced plasma antenna with higher instantaneous bandwidth via the creation of a plasma cloud at the far end of the antenna (i.e. away from the transmitter/receiver to which it is connected) and/or through reducing conductivity towards the far end of the modulated LIPF antenna 12. The focus of the laser may be adjusted until a change in an index of refraction of the optically-transparent medium results the formation of a plasma cloud at a distal end of the LIPF 20. In other words, by modifying a laser beam profile, one can generate a top-hat loading to increase efficiency. The conductivity of the LIPF 20 depends on the intensity of the laser as well as the repetition rate of the laser pulses. The laser has a very high peak power intensity (200 GW) capable of lasting tens of femtoseconds, with the created plasma decaying time in the order of microseconds.

The modulated LIPF antenna 12 (having impedance $Z_a$) may be fed its RF signal via a transmission line of impedance $Z_0$. The amount of power transferred to the antenna depends on the matching impedances of the two, with a maximum for $Z_a=Z_0$. Roughly speaking, the total efficiency of an antenna $e_t$ it is given by the formula:

$$e_t=e_r \times e_c \times e_d \quad \text{(Eq. 4)}$$

where: $e_r$ is reflection efficiency, $e_c$ is the conduction efficiency, and $e_d$ is the dielectric efficiency. By changing the conduction efficiency one can control the overall efficiency of the antenna and that can be done at a very high repetition rate (from a few Hz and lower up to 1 GHz and higher). The laser 18 may be an ultra-short pulses laser (USPL) to generate the plasma filaments. The pulse duration of the laser 10 may be anywhere between 100 attoseconds and 100 nanoseconds, and the time between pulses is adjustable, thereby creating a LIPF 20 having a lifetime in the range of 1 nanosecond to 1 second. Typical pulse duration is between 30-100 fs and the lifetime of the plasma thus generated is in the range of 1-10 ns, at a repetition rate varying from few Hz up to hundreds of MHz (short bursts of GHz). The modulated LIPF antenna 12 is a variable impedance antenna, due to the rapid change of conductivity of the plasma column, allowing one to over-drive the efficiency from zero to a maximum value; the rate of change it is limited only by the laser repetition rate. In one embodiment, the LIPF 20 may be used to intentionally reconfigure the performance (i.e., change to the frequency, gain profile and/or directivity) of a neighboring metallic antenna.

Figure 4:
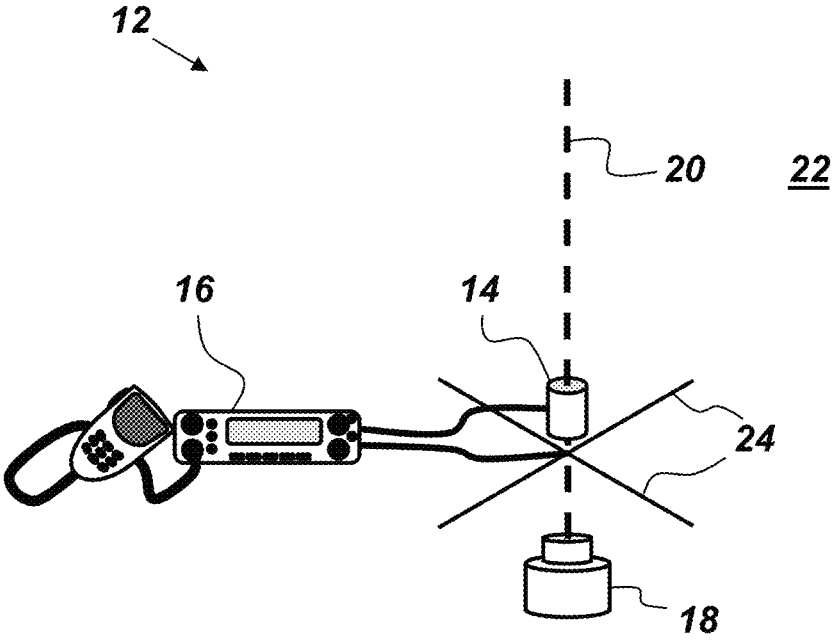
FIG. 4 is an illustration of an embodiment of a modulated LIPF antenna.

FIG. 4 is an illustration of an embodiment of the modulated LIPF antenna 12. In this embodiment, the RF coupler 14 is a cylindrical capacitor that is configured to capacitively feed the modulated LIPF antenna 12. Also shown in FIG. 4 are optional ground radials 24 that may serve as a ground plane or a counterpoise for the modulated antenna 12. By selecting the appropriate operating characteristics of the modulated LIPF antenna 12, the height and average diameter of the LIPF 20 may be controlled thus affecting the performance of the modulated LIPF antenna 12.

Figure 5:
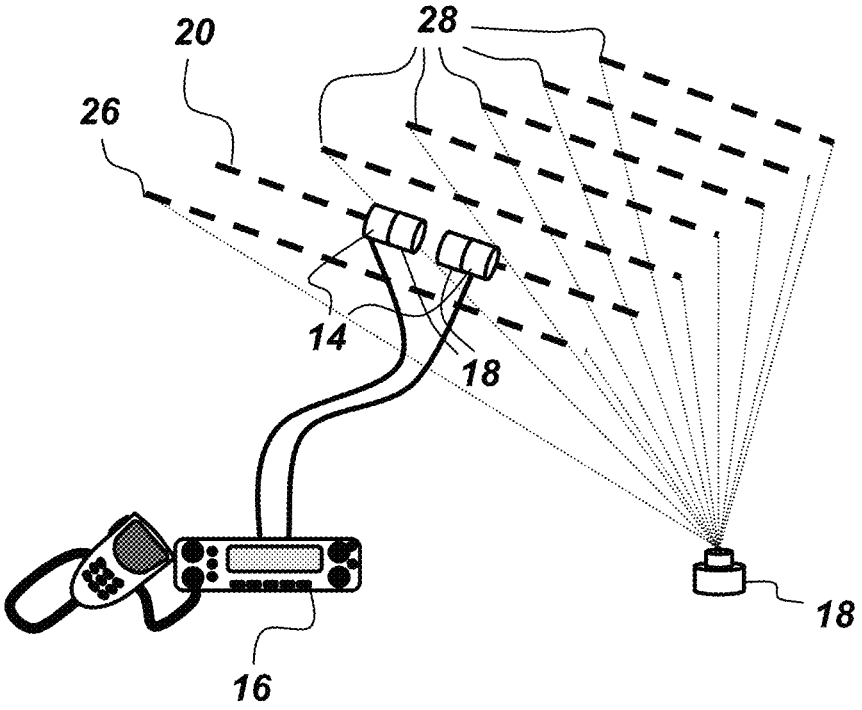
FIG. 5 is an illustration of an embodiment of a modulated LIPF antenna.

FIG. 5 is an illustration of an embodiment of the modulated LIPF antenna 12. In this embodiment, the modulated LIPF antenna 12 is configured as a directional antenna including a reflector element 26, a plurality of director elements 28, and LIPF driven elements 30. The LIPF driven elements 30, in conjunction with their corresponding RF coupler 14 and laser 18, for a dipole antenna. The reflector element 26 and the director elements 28 are LIPFs created by a corresponding laser 18. A LIPF can be created in the air that is not coaxial with the laser beam that is producing the LIPF (such as the reflector element 26 and the director elements 28) by modifying the pulse shape (in time, phase and space) of the laser beam, and by adjusting the focal spot of the laser beam. For example, the focal point of the laser beam can be quickly repositioned in the air 22 in three-dimensional space to ionize the air 22 to form the LIPF of the desired shape and position. The modulated LIPF antenna 12 is easy to configure and to rapidly adapt to different applications or operating conditions. It can be used as a rapidly-deployed, temporary substitute for a damaged metallic antenna, which can be advantageous in many scenarios including emergency first responder and military scenarios. The length, spacing, and orientation of the reflector element 26 and the director elements 28 may be adjusted in real time to account for varying operating conditions. The modulated LIPF antenna 12 has the benefit of being scalable; the modulated LIPF antenna 12 may be rapidly reconfigured to operate from very low frequencies (VLF) (3-30 kilohertz) to ultra-high frequencies (UHF) (300 megahertz-3 gigahertz) by changing the physical length of the LIPF 20. In other words, the modulated LIPF antenna 12 is capable of rapidly changing operating frequencies without the use of semiconductor switches or mechanical switches/relays.

Figure 6:
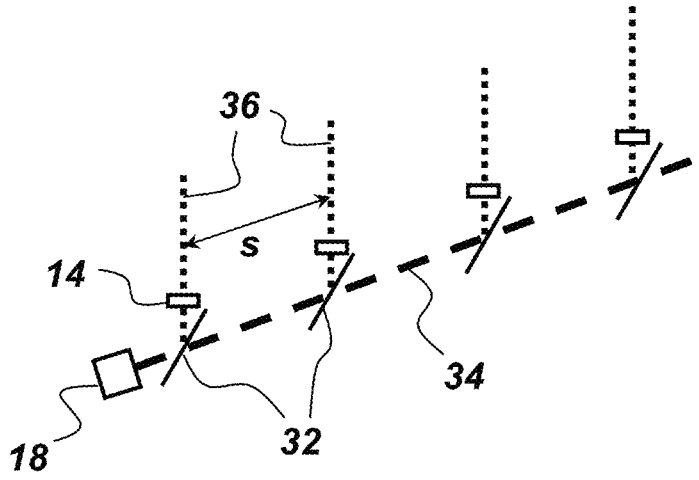
FIG. 6 is an illustration of an array embodiment of a modulated LIPF antenna.

FIG. 6 is an illustration of an array embodiment of the modulated LIPF antenna 12. In this array embodiment, a plurality of beam splitters 32 are placed in the path of a single laser beam 34 from one laser 18. The operating characteristics of the laser beam 34 are adjusted such that a plurality of LIPF antenna elements 36 are created. The LIPF antenna elements 36 behave like rod antennas. The spacing s between the LIPF antenna elements 36 may be adjusted by altering the physical placement of the beam splitters 32.

Figure 7:
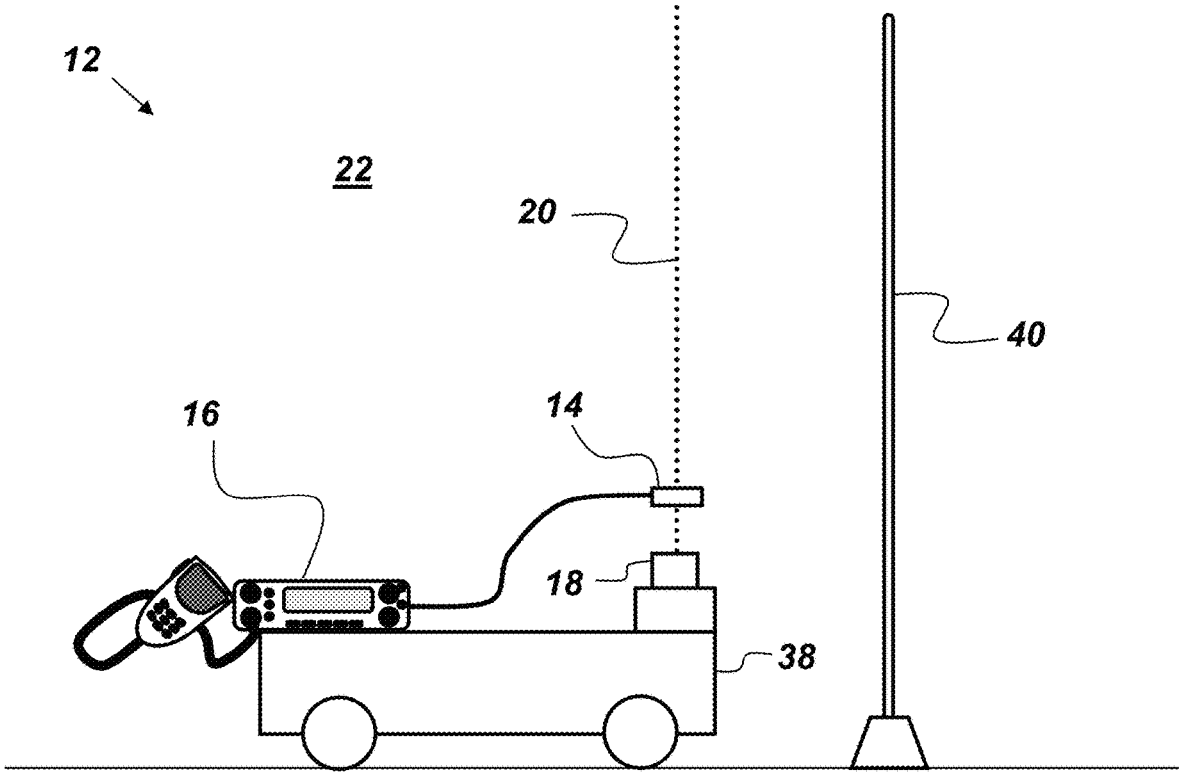
FIG. 7 is an illustration of an embodiment of a modulated LIPF antenna.

FIG. 7 is an illustration of an embodiment of the modulated LIPF antenna 12 where the modulated LIPF antenna 12 is mounted to an optional mobile platform 38. Suitable examples of the mobile platform 38 include, but are not limited to, an aircraft, a vehicle for moving over the ground, and a water-surface vessel. The modulated LIPF antenna 12 may also optionally be placed near a metallic antenna 40 such that the modulated LIPF antenna 12 functions as a reflector for the metallic antenna 40 thereby altering the performance characteristics (e.g., frequency, gain profile, directivity, efficiency) of the metallic antenna 40. Although FIG. 5 shows two lasers 18 being used to create the driven elements 30, it is to be understood that a single laser 18 and a beam splitter may be used to generate the driven elements 30.

Figure 8:
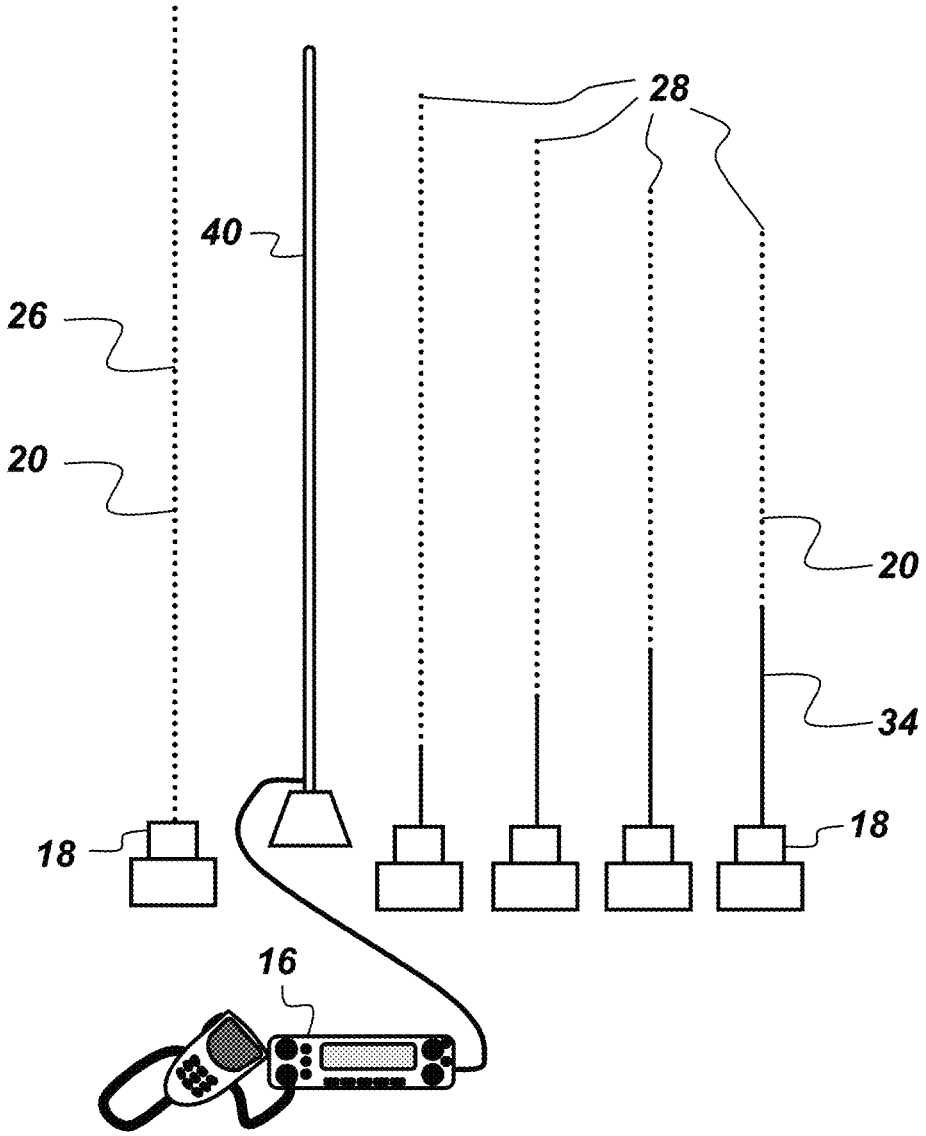
FIG. 8 is an illustration of an embodiment of a modulated LIPF antenna.

FIG. 8 is an illustration of an embodiment of the modulated LIPF antenna 12 where the transceiver is connected to an existing metallic antenna 40 and the laser 18 is used to generate the LIPF 20 that has a length that is longer than the existing metallic antenna 40. The LIPF 20 is positioned with respect to the existing metallic antenna 40 such that the LIPF 20 functions as a reflector 26 for the existing metallic antenna 40. Also shown in FIG. 8 are a plurality of LIPF directors 28 that are parallel to, and shorter in length than, the existing metallic antenna 40. The LIPF directors 28 are positioned on an opposite side of the existing metallic antenna 40 from the reflector 26 such that the LIFP directors 28 absorb and reradiate radio waves from the existing metallic antenna 40 with a different phase, modifying the existing metallic antenna 40's radiation pattern. The modulated LIPF antenna 12 may be used to build complex structures or arrays of antennas the configuration/reconfiguration time being dictated by the speed of light (3 ns/m). For example, for a 100-meter antenna one may expect a "settling time" (time to activate the antenna) of about 33 ns. The LIPF 20 may be used to modulate the impedance of the existing antenna 40 and/or its antenna feed.

The modulated LIPF antenna 12 needs no electrodes to establish the LIPF 20. Complementary techniques such as Vortex Generation may also be used to generate the LIFP 20 to reduce the impact of skin effect and increase the RF conductivity of the plasma. Skin effect is the phenomenon of RF current travelling predominantly in some outer portion of a conductor rather than the entire cross-section of the conductor. The concentration of the laser energy into a hollow tube, thereby creating tubular plasma columns, would provide improved plasma conductivity for a given amount of laser power provided the plasma cross-sectional area is large enough for the skin effect to be relevant.

From the above description of the LIPF antenna modulation method 10 and the modulated LIPF antenna 12, it is manifest that various techniques may be used for implementing the concepts of embodied by the modulated LIPF antenna 12 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the LIPF antenna modulation method 10 and the modulated LIPF antenna 12 are not limited to the particular embodiments described herein, but are capable of many embodiments without departing from the scope of the claims.

We claim:

1. A method for modulating a laser-induced plasma filament (LIPF) antenna comprising the steps of:

using a laser to generate a LIPF within an optically-transparent medium, wherein the laser is configured with an energy of at least 100 mJ and a pulse duration no longer than 20 ns;

communicatively coupling the LIPF to a transceiver; and modulating a conduction efficiency of the LIPF by adjusting the LIPF's localized energy density at a rate within the range of 1 Hz to 1 GHz by altering an optical focal length of the laser thereby creating a variable impedance LIPF antenna.

2. The method of claim 1, further comprising the step of altering the focus of the laser until a change in an index of refraction of the optically-transparent medium results in a plasma cloud formation at a distal end of the LIPF thereby creating an antenna with a high instantaneous bandwidth.

3. A method for modulating a laser-induced plasma filament (LIPF) antenna comprising the steps of:

using a laser to generate a LIPF within an optically-transparent medium, wherein the laser is configured with an energy of at least 100 mJ and a pulse duration no longer than 20 ns;

communicatively coupling the LIPF to a transceiver;

modulating a conduction efficiency of the LIPF by adjusting the LIPF's localized energy density at a rate within the range of 1 Hz to 1 GHz thereby creating a variable impedance LIPF antenna; and adjusting the power of the laser until a desired conductivity of the LIPF at a distal end of the LIPF is achieved thereby creating an antenna with a high instantaneous bandwidth.

4. The method of claim 1, wherein the pulse duration of the laser is between 30-100 femtoseconds thereby creating a LIPF having a lifetime in the range of 1-10 nanoseconds.

5. The method of claim 1, wherein the pulse duration of the laser is between 100 attoseconds and 100 nanoseconds, and wherein the time between pulses is adjustable, thereby creating a LIPF having a lifetime in the range of 1 nanosecond to 1 second.

6. A method for modulating a laser-induced plasma filament (LIPF) antenna comprising the steps of:

using a laser to generate a LIPF within an optically-transparent medium, wherein the laser is configured with an energy of at least 100 mJ and a pulse duration no longer than 20 ns;

communicatively coupling the LIPF to a transceiver;

modulating a conduction efficiency of the LIPF by adjusting the LIPF's localized energy density at a rate within the range of 1 Hz to 1 GHz thereby creating a variable impedance LIPF antenna; and using the variable impedance LIPF antenna as a reflector to reconfigure a neighboring metallic antenna such that a performance characteristic of the neighboring metallic antenna is altered.

7. The method of claim 6, wherein the altered performance characteristic is selected from the group consisting of: frequency, gain profile and directivity.

8. The method of claim 1, wherein the optically-transparent medium is a gas.

9. An antenna comprising:

a first radio frequency (RF) coupler;

a transceiver communicatively coupled to the first RF coupler;

a first laser configured to generate a plurality of femtosecond laser pulses so as to create, without the use of high voltage electrodes, a first laser-induced plasma filament (LIPF) in atmospheric air, wherein the first laser is operatively coupled to the first RF coupler such that RF energy is transferred between the first LIPF and the first RF coupler;

wherein the first laser is configured to modulate a characteristic of the laser pulses at a rate within the range of 1 Hz to 1 GHz so as to modulate a conduction efficiency of the first LIPF thereby creating a variable impedance LIPF antenna;

a second RF coupler communicatively coupled to the transceiver; and a second laser configured to generate a plurality of femtosecond laser pulses so as to create, without the use of high voltage electrodes, a second LIPF in atmospheric air, wherein the second laser is operatively coupled to the second RF coupler such that RF energy is transferred between the second LIPF and the second RF coupler and wherein the second LIPF is disposed with respect to the first LIPF such that together the first and second LIPFs form a dipole antenna.

10. The antenna of claim 9, further comprising a third laser configured to generate a reflector LIPF that has a length that is longer than the dipole antenna, and further configured to generate a plurality of LIPF directors that are parallel to, and shorter in length than, the dipole antenna and are positioned on an opposite side of the dipole antenna from the reflector LIPF such that the LIFP directors absorb and reradiate radio waves from the dipole antenna with a different phase, modifying the dipole antenna's radiation pattern.

11. A method for a laser-induced plasma filament (LIPF) for an antenna element comprising the steps of:

using a laser to generate a LIPF within an optically-transparent medium, wherein the laser is configured with an energy of at least 100 mJ and a pulse duration no longer than 20 ns; and positioning the LIPF with respect to an existing metallic antenna, wherein the LIPF has a length that is longer than the existing metallic antenna such that the LIPF functions as a reflector for the existing metallic antenna thereby altering the existing metallic antenna's directivity.

12. The method of claim 11, further comprising generating a plurality of LIPF directors that are parallel to, and shorter in length than, the existing metallic antenna and are positioned on an opposite side of the existing metallic antenna from the reflector such that the LIFP directors absorb and reradiate radio waves from the existing metallic antenna with a different phase, modifying the existing metallic antenna's radiation pattern.

* * * * *